US009004937B2

(12) United States Patent
Tarulli

(10) Patent No.: US 9,004,937 B2
(45) Date of Patent: Apr. 14, 2015

(54) SURFACE MOUNT/THROUGH-HOLE CRIMP PIERCING ZIPCORD CONNECTOR

(71) Applicant: Zierick Manufacturing Corporation, Mount Kisco, NY (US)

(72) Inventor: Raffaele Tarulli, Irvington, NY (US)

(73) Assignee: Zierick Manufacturing Corporation, Mount Kisco, NY (US)

( * ) Notice: Subject to any disclaimer, the term of this patent is extended or adjusted under 35 U.S.C. 154(b) by 68 days.

(21) Appl. No.: 14/013,228

(22) Filed: Aug. 29, 2013

(65) Prior Publication Data

US 2014/0073171 A1 Mar. 13, 2014

Related U.S. Application Data

(60) Provisional application No. 61/694,861, filed on Aug. 30, 2012.

(51) Int. Cl.

| | |
|---|---|
| ***H01R 11/20*** | (2006.01) |
| ***H01R 4/24*** | (2006.01) |
| ***H01R 43/048*** | (2006.01) |
| ***H01R 12/57*** | (2011.01) |
| ***H01R 12/58*** | (2011.01) |

(52) U.S. Cl.

CPC ..... *H01R 4/2495* (2013.01); *H01R 43/048* (2013.01); *H01R 12/57* (2013.01); *H01R 12/58* (2013.01)

(58) Field of Classification Search

USPC ..... 439/389, 391–426, 442–444; 174/261

See application file for complete search history.

(56) References Cited

U.S. PATENT DOCUMENTS

| | | | | | |
|---|---|---|---|---|---|
| 1,287,542 | A | | 12/1918 | Whitney | |
| 2,749,383 | A | | 6/1956 | Pigman et al. | |
| 3,243,757 | A | * | 3/1966 | Cobaugh | 439/442 |
| 3,320,354 | A | * | 5/1967 | Marley et al. | 174/84 C |
| 3,383,457 | A | * | 5/1968 | Schumacher et al. | 174/261 |
| 3,553,347 | A | * | 1/1971 | Harding et al. | 174/84 C |
| 3,611,262 | A | * | 10/1971 | Marley et al. | 439/392 |
| 3,612,747 | A | * | 10/1971 | Shlesinger, Jr. | 174/84 C |
| 3,662,089 | A | * | 5/1972 | Harding | 174/84 C |
| 3,699,505 | A | * | 10/1972 | Bruner | 439/389 |
| 3,715,456 | A | * | 2/1973 | Faulkner | 174/84 C |
| 3,743,748 | A | * | 7/1973 | Reeder | 174/75 C |
| 3,767,841 | A | * | 10/1973 | Anderson et al. | 174/84 C |
| 3,798,347 | A | * | 3/1974 | Harding et al. | 174/84 C |
| 3,854,114 | A | * | 12/1974 | Kloth et al. | 439/398 |
| 3,912,853 | A | * | 10/1975 | Wilkes | 174/84 C |
| 3,937,403 | A | * | 2/1976 | Lawson | 439/424 |

(Continued)

*Primary Examiner* — Ross Gushi

(74) *Attorney, Agent, or Firm* — Myron Greenspan Lackenbach Siegel LLP

(57) ABSTRACT

A through-the-hole (TTH)/surface mount (SMT) insulation piercing connector includes one or two spaced electrical contacts. Each contact has a flat plate portion and integrally-formed legs. An L-shaped hook portion on the flat plate portion has a piercing tip pointed in a direction away from the legs. The piercing tip is spaced from the flat plate portion, the flat plate portion being configured and dimensioned to bend in the direction towards the piercing tip when pressed to urge an insulated wire onto said piercing tip to cause it to penetrate the wire insulation and make electrical contact with the internal conductive wires or strands within the wire. The legs are insertable into mounting holes in a substrate for direct TTH mounting in a PCB or to be secured to a header provided with mounting holes by TTH soldering and surface mounting by a pick-and-place machine acting on the header.

20 Claims, 2 Drawing Sheets

(56) References Cited

U.S. PATENT DOCUMENTS

| | | | | | |
|---|---|---|---|---|---|
| 3,960,430 | A * | 6/1976 | Bunnell et al. | 439/422 |
| 3,963,857 | A * | 6/1976 | Reynolds et al. | 174/84 C |
| 4,075,417 | A * | 2/1978 | Neale, Sr. | 174/84 C |
| 4,217,022 | A * | 8/1980 | Carre | 439/404 |
| 4,533,199 | A * | 8/1985 | Feldberg | 439/404 |
| 4,655,520 | A | 4/1987 | Cummings | |
| 4,701,001 | A * | 10/1987 | Verhoeven | 439/394 |
| 4,749,368 | A * | 6/1988 | Mouissie | 439/421 |
| 4,790,771 | A * | 12/1988 | Kleiner | 439/421 |
| 4,842,546 | A | 6/1989 | Song | |
| 4,973,261 | A * | 11/1990 | Hatagishi et al. | 439/397 |
| 5,110,387 | A * | 5/1992 | Jasinski et al. | 156/222 |
| 5,484,305 | A * | 1/1996 | Diniz et al. | 439/421 |
| 5,549,484 | A * | 8/1996 | Chen | 439/417 |
| 5,577,930 | A * | 11/1996 | Dahlem et al. | 439/399 |
| 5,603,636 | A * | 2/1997 | Kanou et al. | 439/585 |
| 5,616,047 | A * | 4/1997 | Lutsch | 439/397 |
| 5,713,767 | A * | 2/1998 | Hanson et al. | 439/853 |
| 5,785,548 | A * | 7/1998 | Capper et al. | 439/409 |
| 5,997,337 | A * | 12/1999 | Torii | 439/399 |
| 6,007,366 | A * | 12/1999 | Torii et al. | 439/397 |
| 6,019,637 | A * | 2/2000 | Iwata et al. | 439/595 |
| 6,050,845 | A * | 4/2000 | Smalley et al. | 439/417 |
| 6,093,048 | A * | 7/2000 | Arnett et al. | 439/404 |
| 6,135,821 | A * | 10/2000 | Liu | 439/676 |
| 6,372,990 | B1 * | 4/2002 | Saito et al. | 174/74 R |
| 6,443,738 | B2 * | 9/2002 | Yamanashi et al. | 439/45 |
| 6,657,127 | B2 * | 12/2003 | Saito | 174/84 C |
| 6,799,990 | B2 * | 10/2004 | Wendling et al. | 439/422 |
| 6,835,089 | B2 * | 12/2004 | Hayes et al. | 439/404 |
| 6,863,558 | B2 | 3/2005 | Negishi et al. | |
| 6,875,043 | B2 * | 4/2005 | Turek et al. | 439/397 |
| 7,077,687 | B1 * | 7/2006 | Feistkorn et al. | 439/406 |
| 7,097,491 | B2 * | 8/2006 | Neumann-Henneberg | 439/395 |
| 7,270,564 | B1 * | 9/2007 | Boischio | 439/417 |
| 7,448,900 | B1 | 11/2008 | Chen | |
| 7,833,045 | B2 * | 11/2010 | Bishop | 439/404 |
| 7,901,238 | B1 * | 3/2011 | Muir et al. | 439/417 |
| 7,955,116 | B2 * | 6/2011 | Bishop | 439/404 |
| 7,976,334 | B2 * | 7/2011 | Bishop | 439/404 |
| 8,109,783 | B2 * | 2/2012 | Bishop et al. | 439/404 |
| 8,128,427 | B2 * | 3/2012 | Mochizuki | 439/419 |
| 8,192,223 | B2 * | 6/2012 | Bishop | 439/404 |
| 8,568,157 | B2 * | 10/2013 | Bishop | 439/389 |
| 8,636,537 | B2 * | 1/2014 | Kettern et al. | 439/389 |
| 8,672,703 | B2 * | 3/2014 | Fehling et al. | 439/417 |
| 8,684,761 | B2 * | 4/2014 | Weaver et al. | 439/404 |
| 8,714,996 | B2 * | 5/2014 | Bishop | 439/404 |
| 8,740,638 | B2 * | 6/2014 | Lappoehn | 439/397 |
| 8,758,041 | B2 * | 6/2014 | Bishop et al. | 439/404 |
| 2006/0189174 | A1 * | 8/2006 | Fabian et al. | 439/66 |
| 2007/0082539 | A1 * | 4/2007 | Pavlovic | 439/400 |
| 2007/0254521 | A1 * | 11/2007 | D'Agostini et al. | 439/404 |
| 2007/0294873 | A1 * | 12/2007 | Bogursky et al. | 29/34 D |
| 2009/0117774 | A1 * | 5/2009 | Legrady et al. | 439/449 |
| 2012/0061140 | A1 * | 3/2012 | Nonen et al. | 174/84 C |
| 2012/0322294 | A1 * | 12/2012 | Lappoehn | 439/397 |
| 2014/0060929 | A1 * | 3/2014 | Rice | 174/84 C |
| 2014/0073171 | A1 * | 3/2014 | Tarulli | 439/421 |

* cited by examiner

SURFACE MOUNT/THROUGH-HOLE CRIMP PIERCING ZIPCORD CONNECTOR

BACKGROUND OF THE INVENTION

1. Field of the Invention

The invention generally relates to surface mount connectors and, more specifically, to a through-the-hole (TTH)/surface mount (SM) insulation piercing connector (IPC).

2. Description of the Prior Art

Zipcord connectors are generally two insulated conductors that are fused along a weakened parting line to allow the user to separate the conductors by tearing the conductors apart along the parting line. Such conductors are frequently used for table lamps, small household appliances to connect loudspeakers, etc. At times, it is necessary and desirable to terminate a zipcord on a printed circuit board in an automated or semi-automated manner.

The prior art shows that numerous connectors have been proposed for securing the wires and/or the conductors of a pair of wires, including a "Lamp Mounting" issued to Whitney under U.S. Pat. No. 1,287,542. However, the patent is for a lamp mounting and the wires are not a zipcord but two separate spaced wires and the connector forms a part of a lamp socket that is not suitable for surface mounting.

U.S. Pat. No. 3,937,403 discloses an "Electrical Terminals For Flat Wire" such as antenna wires used for connecting a television receiver to an antenna. However, the terminal must be severed into two halves after the zipcord is secured. The disclosure is not for an SMT connector. Unless, the two wires of the zipcord are severed and separated, they continue to be in electrical contact with each other and therefore, would not suitably serve as a connector since both lines would be shorted to each other. Additionally, the terminals are not designed nor are they suitable for use as an SMT connector.

SUMMARY OF THE INVENTION

Accordingly, it is an object of the present invention to provide a versatile insulation piercing connector (IPC).

It is another object of the present invention to provide an IPC that can be directly secured to a printed circuit board (PCB) or, using TTH technology attached to a header that can then be surface mounted using automated equipment.

It still another object of the present invention to provide an IPC connector of the type under discussion that is particularly useful for reliably electrically and mechanically securing and terminating a zipcord to a PCB.

It is yet another object of the present invention to provide an IPC connector as in the previous objects wherein the zipcord can continue and be multiply terminated on the same printed circuit board.

It is a further object of the present invention to provide an IPC of the type under discussion that is simple in construction and inexpensive to manufacture.

It is still a further object of the present invention to provide acceptable wire retention strength after the termination and strain relief as a result of crimping.

It is yet a further object of the present invention to provide an IPC connector that can be dimensionally modified to fit a variety of zipcord wires sizes.

In order to achieve the above and other objects a through-the-hole (TTH)/surface mount (SM) insulation piercing connector (IPC) is formed of a generally vertical plate portion, when in use. The vertical direction is intended to define a direction that is generally normal to a printed circuit board (PCB) the plane of which can be considered as a reference plane. A plurality of spaced legs extend vertically downwardly below the plate portion. At least one generally L-shaped hook portion projects from one side of the plate portion to form at its free end a piercing tip pointed vertically upwardly at a spaced predetermined distance from the plate portion and arranged to penetrate insulation and contact internal conductive wires within a conductor. At least one horizontal score line or coin is preferably provided on a surface of the plate portion facing the L-shaped hook portion generally parallel to the PCB to facilitate bending/curling of the upper region of the vertical plate portion over and onto an insulated conductor positioned over the piercing tip. The legs are insertable into mounting holes of a PCB for direct TTH mounting or may be secured to a header provided with mounting holes by TTH soldering and surface mounting by means of a pick-and-place or other automated machine acting on the header.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
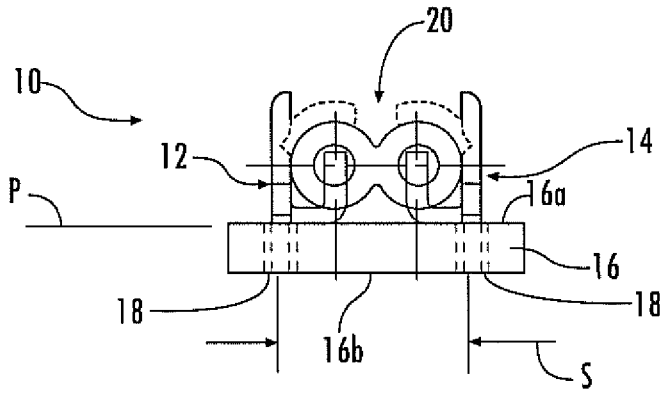
FIG. 1 is a front elevational view of an IPC connector in accordance with the present invention, shown mounted on a header with a zipcord positioned between the two spaced IPC connectors and showing in dash outline, the positions of the upper portions of the IPC connectors when crimped by bending or curling the upper portions about coins formed in the walls of the IPC to force the zipcord downwardly and force the pointed piercing tips to pierce the insulation to engage the conductors.

Referring specifically to the Figures, in which identical or similar parts are designated by the same reference numerals throughout, and first referring to FIG. 1, an insulation piercing connector (IPC) assembly is generally designated by the reference numeral 10.

The assembly 10 formed of two spaced IPC electrical contacts 12, 14 in accordance with the invention. The contacts 12, 14 are spaced from each other a distance S. While the IPC contacts 12, 14 may be identical they are mounted to provide mirror images of each other as shown in FIG. 1. The IPC contacts 12, 14 are mounted on a substrate 16. As will be more fully discussed below the substrate 16 may be a printed circuit board (PCB) or may be a dedicated assembly header that can be surface mounted on a PCB board, The substrate 16 is provided with "through-the-hole" (TTH) 18, for reasons to be described, and has an upper surface 16*a* that defines a plane "P" and a lower surface 16*b*.

Figure 2:
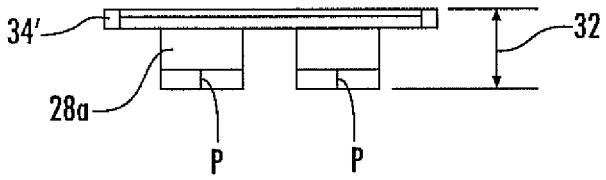
FIG. 2 is a top plan view of an IPC connector in accordance with the invention.
Figure 3:
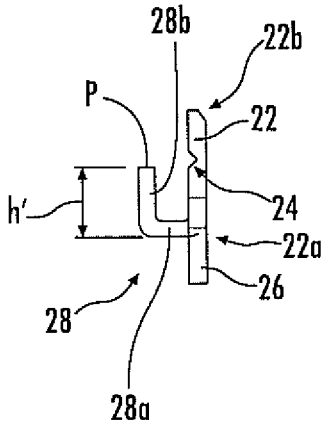
FIG. 3 is an end elevational view of the IPC shown in FIG. 2.
Figure 4:
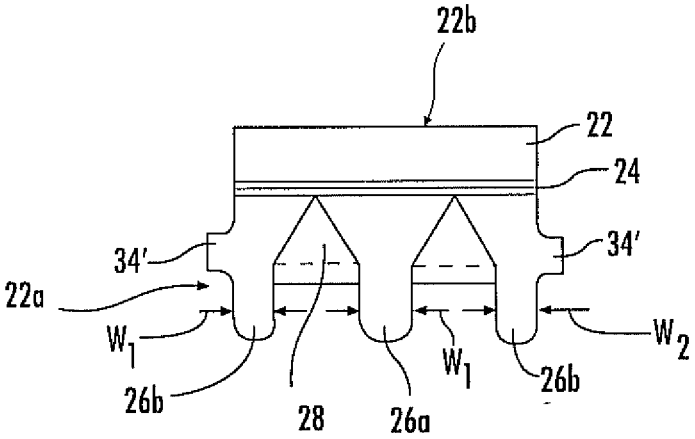
FIG. 4 is a front elevational view of the IPC shown in FIGS. 2 and 3.

Referring to FIGS. 2-4, each IPC contact 12, 14 is formed of a vertical flat plate portion 22 that defines parallel first and second opposing sides 22*a*, 22*b*, respectively. (FIG. 3). For purposes of description, the vertical direction is one generally perpendicular to a printed circuit board or header on which the IPC is to be mounted. On one inner surface of the plate portion 22, there is provided at least one score line or V-coin 24. The angle of the score line is not critical although a 90° coin is shown. The score line 24 is spaced below the upper edge of the vertical plate portion 22, as shown in FIG. 3. As best shown in FIG. 4, extending downwardly below the first side 22*a* are a plurality of legs 26*a*, 26*b*. The widths of these legs are not critical, although the width $w_1$ of the middle leg 26*a* is shown somewhat wider than the widths $w_2$ of the end legs 26*b*, as long as they can be received within the holes 38, 40 and 42, 44 in the substrate 16.

Figure 5:
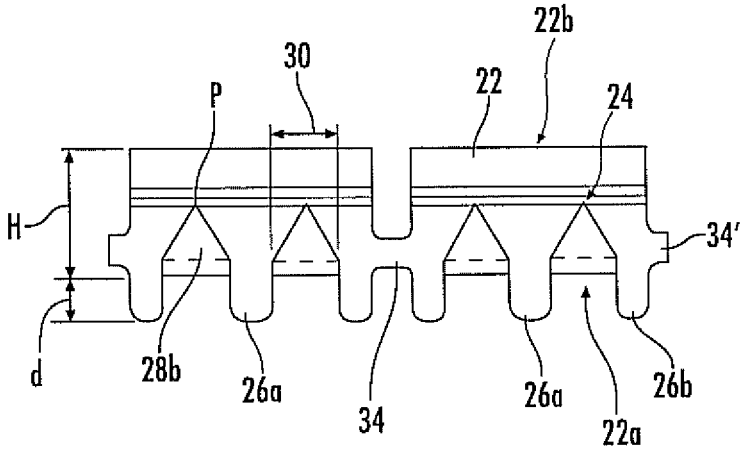
FIG. 5 shows a strip of IPC connectors of the type shown in FIGS. 2-4.

Extending from same side of the vertical flat plate portion 22 in which the score line or coin 24 is formed is an L-shaped hook portion 28 that projects laterally and then upwardly in a direction parallel to the flat plate portion 22, as best shown in FIG. 3. The depth 32 (FIG. 2) of the portion 28*a* is selected to substantially align the hook portion 28*b* with the center of a conductor that is to be pierced and secured. The piercing tip 28*b* is generally formed as en equilateral triangle and is formed with a point "p" that has a height h' sufficient to penetrate into electrical wire conductors of the pierced conductor. The legs 26*a*, 26*b* extend below the L-shaped hook portion 28 a depth "d" (FIG. 5) so that when the legs are inserted into a through-hole the portion 28*a* of the hook 28 substantially rests upon the upper surface 16*a* of the substrate, as shown in FIG. 1. This minimizes bending or excessive movements of the IPC during the crimping and penetration steps as the L-shaped hook is supported by the substrate itself. Preferably depth "d" of the legs 26*a*, 26*b* is selected so that the legs do not project or extend below a substrate, particularly when inserted in a header to be surface mounted on a PCB.

It should be evident that with the construction shown the distance S can be modified to accommodate different size zipcords 20 by simply changing the spacings S between the holes 18 in the substrate.

While the IPC connector in accordance with the invention is preferably used in pairs, as shown in FIG. 1, to capture and electrically and mechanically connect to a zipcord or two individual conductors, a single IPC contact can also be used to secure and connect to a single insulated conductor, although additional care may need to be taken to prevent the conductor from moving laterally outwardly, away from the vertical wall portion 22, during the crimping or curling step of the IPC connector.

It will be evident, therefore, that the IPC in accordance with the invention can terminate two independent insulated conductors simultaneously. The connector, as suggested, is preferably used in pairs with each terminating a single insulated conductor that remain electrically isolated from each other.

The IPC connectors may be formed of brass or other suitable material and these can be used in two ways. First, they can be assembled in a header assembly, as shown in FIG. 1, which can then be surface mounted on a printed circuit board. Also, the connector can be mounted directly on a printed circuit board and arranged in pairs using either a surface mounting method or pin-through-paste method. The crimping tool then folds over the sides to retain the wire in place. The header assembly or formed part can be reflowe soldered in an oven at 250-255° C.

Figure 7:
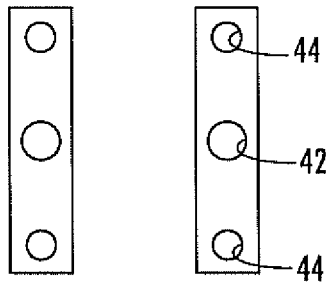
FIG. 7 is top plan view of solder pads of the type that may be used on a header shown in FIG. 1.
Figure 6:
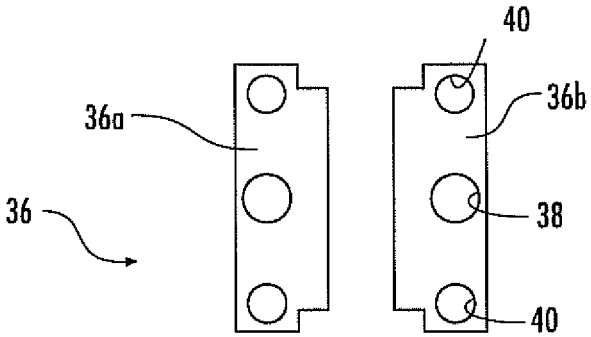
FIG. 6 is top plan view of copper lands or pads that can be used for direct TTH mounting of a pair of IPC connectors in accordance with the invention directly on a PCB.
Figure 8:
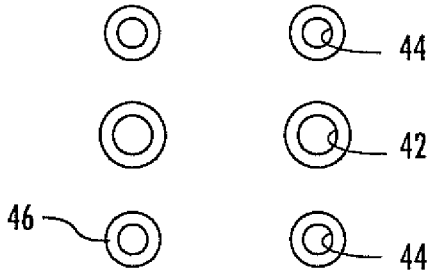
FIG. 8 is bottom plane view of the component or bottom side of the header shown in FIG. 1.

Referring to FIG. 6, there are shown a pair of copper pads 36, in which each of the pads 36*a*, 36*b* are similarly formed and are mirror images of each other. As indicated, the center holes 38 are somewhat bigger in diameter than the diameters of the end holes 40 to accommodate slightly different widths of the legs 26*a*, 26*b*. In FIGS. 7 and 8 the pads and TTI-I holes are shown for direct mounting on a PCB. FIG. 7 illustrates the configuration on the solder side of the PCB, while FIG. 8 shows the configuration on the component side. To facilitate soldering of the IPC plated through-hole contacts 46 are provided that bond to the legs of the IPC connector.

Whether directly mounted on a PCB or on a header substrate, the IPC connectors in accordance with the present invention are inexpensive to manufacture, they provide versatility and flexibility to accommodate different sized conductors, such as zipcords, without the need to maintain an extended inventory of differently sized IPC connectors for differently sized conductors. The IPC connectors of the invention provide another method to achieve wire to board connection and have the advantage that the wire does not need to be separated nor stripped prior to application.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A through-the-hole (TTH)/surface mount (SMT) insulation piercing connector comprises an electrical contact including a generally flat plate portion that defines a reference plane generally normal to a printed circuit board (PCB) on which the connector is to be mounted and defines generally parallel first and second opposing sides; a plurality of integrally-formed legs within said reference plane projecting beyond said first side of said flat plate portion; at least one generally L-shaped hook portion integrally formed on one surface of said flat plate portion at a point intermediate said first and second sides to form at a free end a piercing tip pointed in a direction of said second side and away from said legs, said piercing tip being spaced a predetermined distance from said flat plate portion, said second side of said flat plate portion being configured and dimensioned to crimp and bend in the direction towards said piercing tip when a suitable tool is pressed onto said second side to urge an insulated wire placed above a piercing tip onto said piercing tip to cause said piercing tip to penetrate the wire insulation and make electrical contact with internal conductive wires or strands within the wire when said second side of said flat plate portion is crimped, said legs being insertable into mounting holes of a substrate for direct TTH mounting in a PCB or be secured to a header provided with mounting holes by TTH soldering and surface mounting by means of a pick-and-place or other automated machine acting on the header.

2. A through-the-hole (TTH)/surface mount (SMT) insulation piercing connector (IPC) as defined in claim 1, wherein said legs are spaced from each other.

3. A through-the-hole (TTH)/surface mount (SMT) insulation piercing connector (IPC) as defined in claim 1, wherein said spacing is substantially uniform.

4. A through-the-hole (TTH)/surface mount (SMT) insulation piercing connector (IPC) as defined in claim 1, wherein said legs are configured at their free ends to facilitate insertion into the holes in a substrate.

5. A through-the-hole (TTH)/surface mount (SMT) insulation piercing connector (IPC) as defined in claim 1, in combination with said substrate.

6. A through-the-hole (TTH)/surface mount (SMT) insulation piercing connector (IPC) as defined in claim 5, wherein said substrate is a header provided with TTH holes and has a surface suitable for surface mounting on a PCB.

7. A through-the-hole (TTH)/surface mount (SMT) insulation piercing connector (IPC) as defined in claim 1, wherein said substrate is a printed circuit board (PCB) for TTH direct mounting.

8. A through-the-hole (TTH)/surface mount (SMT) insulation piercing connector (IPC) as defined in claim 1, wherein a pair of contacts are provided and spaced on a substrate to position said hook portion facing each other and to receive a pair of wires, such as a zipcord, on respective hook portions to each make electrical contact with another associated wire while electrically isolating the pair of wires.

9. A through-the-hole (TTH)/surface mount (SMT) insulation piercing connector (IPC) as defined in claim 1, further comprising at least one elongate coin or notch between said first and second edges to facilitate crimping or bending of said second edge.

10. A through-the-hole (TTH)/surface mount (SMT) insulation piercing connector (IPC) as defined in claim 9, wherein said coin or notch is substantially parallel to said first and second sides.

11. A through-the-hole (TTH)/surface mount (SMT) insulation piercing connector (IPC) as defined in claim 9, wherein said coin or notch has a V-shaped cross-section.

12. A through-the-hole (TTH)/surface mount (SMT) insulation piercing connector (IPC) as defined in claim 9, wherein the spacing of said coin or notch from said first side substantially corresponds to the height of said piercing tips in a plane substantially parallel to said reference plane.

13. A through-the-hole (TTH)/surface mount (SMT) insulation piercing connector (IPC) as defined in claim 1, wherein said contact is die cut from a sheet of conductive material.

14. A through-the-hole (TTH)/surface mount (SMT) insulation piercing connector (IPC) as defined in claim 1, wherein said contact is formed as a strip of a plurality of contacts connected to each other by frangible tabs.

15. A through-the-hole (TTH)/surface mount (SMT) insulation piercing connector (IPC) as defined in claim 1, wherein the length of said hook portions substantially correspond to the thickness of the substrate to be fully received within holes formed in said substrate.

16. A through-the-hole (TTH)/surface mount (SMT) insulation piercing connector (IPC) as defined in claim 1, wherein said piercing tips have a triangular shape.

17. A through-the-hole (TTH)/surface mount (SMT) insulation piercing connector (IPC) as defined in claim 16, wherein said triangular shape substantially corresponds to an equilateral triangle.

18. A method of mounting a through-the-hole (TTH)/surface mount (SMT) insulation piercing connector that includes a generally flat plate portion of an electrical contact that defines a reference plane generally normal to a substrate on which the connector is to be mounted and defines generally parallel first and second opposing sides; a plurality of integrally-formed legs within said reference plane projecting beyond said first side of said flat plate portion; at least one generally L-shaped hook portion integrally formed on one surface of said flat plate portion at a point intermediate said first and second sides to form at a free end a piercing tip pointed in a direction of said second side and away from said legs, said piercing tip being spaced a predetermined distance from said flat plate portion, said second side of said flat plate portion being configured and dimensioned to crimp and bend in the direction towards said piercing tip when a suitable tool is pressed onto said second side to urge an insulated wire placed above a piercing tip onto said piercing tip to cause said piercing tip to penetrate the wire insulation and make electrical contact with internal conductive wires or strands within the wire when said second side of said flat plate portion is crimped, the method comprising the steps of forming at least one land or conductive pad on a substrate; forming at least one hole through said at least one land or conductive pad on said substrate dimensioned to receive a leg into each formed hole; inserting a leg of each electrical contact into an associated hole; and mechanically and electrically connecting the electrical contact to the land or conductive pad and substrate; said legs being insertable into mounting holes of the substrate for direct TTH mounting in a PCB or be secured to a header provided with mounting holes by TTH soldering and surface mounting by means of a pick-and-place or other automated machine acting on the header.

19. A method of attaching an insulated or clad conductor to a through-the-hole (TTH)/surface mount (SMT) insulation piercing connector comprises a generally flat plate portion of an electrical contact that defines a reference plane generally normal to a substrate on which the connector is to be mounted and defines generally parallel first and second opposing sides; a plurality of integrally-formed legs within said reference plane projecting beyond said first side of said flat plate portion; at least one generally L-shaped hook portion integrally formed on one surface of said flat plate portion at a point intermediate said first and second sides to form at a free end a piercing tip pointed in a direction of said second side and away from said legs, said piercing tip being spaced a predetermined distance from said flat plate portion, said second side of said flat plate portion being configured and dimensioned to crimp and bend in the direction towards said piercing tip when a suitable tool is pressed onto said second side to urge an insulated wire placed above a piercing tip onto said piercing tip to cause said piercing tip to penetrate the wire insulation and make electrical contact with internal conductive wires or strands within the wire when said second side of said flat plate portion is crimped, the method comprising the steps of forming at least one land or conductive pad on a substrate; forming at least one hole through said at least one land or conductive pad on said substrate dimensioned to receive a leg into each formed hole; inserting a leg of each electrical contact into an associated hole; and mechanically and electrically connecting the electrical contact to the land or conductive pad and substrate; said legs being insertable into mounting holes of the substrate for direct TTH mounting in a PCB or be secured to a header provided with mounting holes by TTH soldering and surface mounting by means of a pick-and-place or other automated machine acting on the header; positioning on insulated or clad conductor above at least one piercing tip and in contact with said flat plate portion to position conductive wires or strands within the insulated or clad conductor substantially above and aligned with said piercing tip; and crimping or bending, using a press or tool to crimp or curl said second side of said flat plate portion to contact and force the conductor against said piercing tips to pierce the insulation and make electrical contact with the conductive wires or strands within the insulated.

20. A method of attaching an insulated or clad conductor to a through-the-hole (TTH)/surface mount (SMT) insulation piercing connector (IPC) as defined in claim 19, wherein two electrical contacts are spaced from each other a distance substantially corresponding to the width of a zipcord or two independent insulated conductors with said piercing tips facing inwardly towards each other to allow two conductors to be mechanically and electrically terminated while maintaining electrical isolation therebetween.

* * * * *